US005758204A

United States Patent [19]

Haneda et al.

[11] Patent Number: 5,758,204

[45] Date of Patent: May 26, 1998

[54] DUPLEX IMAGE FORMING APPARATUS WITH TWO IMAGE CARRIERS AND AN IMAGE SIZE DISCRIMINATOR

[75] Inventors: Satoshi Haneda; Kunio Shigeta; Yotaro Sato; Tadayoshi Ikeda; Masakazu Fukuchi; Akitoshi Matsubara, all of Hachioji, Japan

[73] Assignee: Konica Corporation, Tokyo, Japan

[21] Appl. No.: 831,680

[22] Filed: Apr. 10, 1997

[30] Foreign Application Priority Data

Apr. 15, 1996 [JP] Japan ..... 8-092476

[51] Int. Cl.[6] ..... G03G 15/16

[52] U.S. Cl. ..... 399/66; 399/309

[58] Field of Search ..... 399/66, 297, 298, 399/300, 302, 303, 308, 309, 312, 364

[56] References Cited

FOREIGN PATENT DOCUMENTS

| | | |
|---|---|---|
| 49-37538 | 10/1974 | Japan . |
| 54-28740 | 9/1979 | Japan . |
| 63-180969 | 7/1988 | Japan . |
| 63-298255 | 12/1988 | Japan . |
| 64-44457 | 2/1989 | Japan . |
| 4-214576 | 8/1992 | Japan . |

*Primary Examiner*—S. Lee

*Attorney, Agent, or Firm*—Frishauf, Holtz, Goodman, Langer & Chick

[57] ABSTRACT

An image forming apparatus has a photoreceptor drum and a toner image receptor for forming toner images on both sides of a transfer sheet. The apparatus includes a photoreceptor drum; a toner image forming unit for forming a toner image on the photoreceptor drum; a toner image receptor, disposed facing the photoreceptor drum, for holding the toner image; a first transfer unit for transferring the toner image, on the photoreceptor drum, to one side surface of a transfer sheet; a second transfer unit for transferring the toner image, on the toner image receptor, to the other side surface of the transfer sheet; a fixing unit for fixing the toner image transferred to both side surfaces of the transfer sheet; an image size discriminator for discriminating a size of an image to be formed by the image forming apparatus, and for generating a signal corresponding to the discriminated size; and a control unit for controlling the image forming apparatus so that either the toner image corresponding to one page is formed on the toner image receptor or the toner image corresponding to plural pages is formed on the toner image receptor according to the signal generated by the image size discriminator.

9 Claims, 10 Drawing Sheets

DUPLEX IMAGE FORMING APPARATUS WITH TWO IMAGE CARRIERS AND AN IMAGE SIZE DISCRIMINATOR

BACKGROUND OF THE INVENTION

The present invention relates to an electrophotographic image forming apparatus such as a copying machine, a printer and a FAX (facsimile transmitter/receiver) in which a charging device an imagewise exposure device and a developing device are arranged around an image carrier, and a toner image formed on the image carrier is transferred onto a transfer material and fixed thereon.

Heretofore, in the case of duplex copying, there has been employed a method in which an image formed on an image carrier is transferred and fixed on one side of a transfer material which is then put in a RDF device temporarily, and the transfer material is fed out of the RDF device in synchronization with an image formed on the image carrier again so that the image may be transferred and fixed on the other side of the transfer material.

In the duplex copying apparatus, a transfer material is fed into the RDF device and is conveyed to pass through a fixing unit twice, as stated above. Therefore, conveyance of a transfer material has been low in reliability and has caused jamming and other problems. Contrary to this, Japanese Patent Examined Publication Nos. 37538/1974 and 28740/1979, and Japanese Patent Publication Open to Public Inspection Nos. 44457/1989 and 214576/1992 (hereinafter referred to as Japanese Patent O.P.I. Publication) have suggested a method in which toner images are formed on both sides of a transfer material and then, they are fixed simultaneously. Japanese Patent O.P.I. Publication Nos. 44457/1989 and 214576/1992, in particular, have suggested a method in which a plurality of image forming means each being composed of an image carrier, a charging means, an imagewise exposure means and a developing means are arranged in parallel on a toner image receptor, to form a two-sided copy with color images.

However, in the duplex color image forming methods suggested in Japanese Patent O.P.I. Publication Nos. 44457/1989 and 214576/1992 mentioned above, deteriorations of images such as color doubling, scattered toner and frictional damage of toner are easily caused because a color toner image of each color is superposed in succession on a toner image receptor, although transportability of a transfer material is improved.

In view of the foregoing, the inventors of the present invention studied duplex image forming methods in which toner images formed on an image carrier are collectively transferred onto a toner image receptor, and toner images on the toner image receptor and toner images formed on the image carrier again are respectively transferred on both sides of a transfer material. In this method, however, there is a problem in that when a small size print, such as an A-4 size print, for example, needs to be made, a printing speed for the A-4 size print is limited to the printing speed for the A-3 size which is usually the maximum size for the toner image receptor, resulting in the problem that speed-up is difficult and an efficiency of using the toner image receptor is poor. There is a problem that it is especially difficult to achieve speed-up for making one print in a small size, such as an A-4 size, for example.

SUMMARY OF THE INVENTION

An object of the invention is to provide an image forming apparatus in which the problems mentioned above have been solved, and the printing speed has been raised by efficient use of a toner image receptor, for forming two-sided copies.

An image forming apparatus of the invention in which the object mentioned above is achieved comprises of a first image carrier that carries toner images formed by a toner image forming unit on its surface, a second image carrier to which the toner images carried by the first image carrier are collectively transferred to be carried thereon as the transferred toner images, a first transfer unit that transfers the toner images carried by the first image carrier onto one side of a transfer material, a second transfer unit that transfers the toner images carried by the second image carrier onto the other side of the transfer material, and a fixing unit that fixes toner images transferred onto both sides of the transfer material. On the image forming apparatus, there is provided an image size discriminator that discriminates a size of an image formed by the image forming apparatus, and when the image size discriminator indicates that the second image carrier can carry toner images on plural sheets in terms of image size, in the case of duplex image forming for plural sheets, continuous forming of obverse images on the first image carrier and continuous duplex image forming on the transfer material are repeated, after images on the reverse for plural sheets are carried continuously on the second image carrier. Further, when the image size discriminator indicates that the second image carrier can carry toner images on a single sheet in terms of image size, forming of obverse images on the first image carrier and duplex image forming on the transfer material are repeated, after images on the reverse for a single sheet are carried on the second image carrier.

Another example of an image forming apparatus of the invention in which the object mentioned above is achieved, comprises a first image carrier that carries toner images formed by a toner image forming unit on its surface, a second image carrier to which the toner images carried by the first image carrier are collectively transferred to be carried thereon as the transferred toner images, a first transfer unit that transfers the toner images carried by the first image carrier onto one side of a transfer material, a second transfer unit that transfers the toner images carried by the second image carrier onto the other side of the transfer material, and a fixing unit that fixes toner images transferred onto both sides of the transfer material. In the case of duplex image forming, after images for the reverse are carried on the second image carrier, the second image is moved at high speed temporarily, images for the obverse are formed on the first image carrier and duplex image forming on a transfer material is conducted.

Still another example of the image forming apparatus of the invention in which the object mentioned above is achieved, comprises a first image carrier that carries toner images formed by a toner image forming unit on its surface, a second image carrier to which the toner images carried by the first image carrier are collectively transferred to be carried thereon as the transferred toner images, a first transfer unit that transfers the toner images carried by the first image carrier onto one side of a transfer material, a second transfer unit that transfers the toner images carried by the second image carrier onto the other side of the transfer material, and a fixing unit that fixes toner images transferred onto both sides of the transfer material. In this image forming apparatus, the maximum image size of a toner image which can be carried on the second image carrier is smaller than that of a toner image which can be formed by the first image carrier.

DETAILED DESCRIPTION OF THE INVENTION

Embodiments of the invention will be explained as follows. Incidentally, neither the technical scope of the claims nor the signification of terminology is limited by the description in this section. Further, the conclusive explanations in the embodiments of the invention show the best mode, and they limit neither the signification of terminology nor the technical scope of the invention. Furthermore, in the explanation of the following embodiments, an image to be transferred onto the transfer material surface facing an image carrier in the transfer area is assumed to be an image for the obverse, while an image to be transferred onto the other side of the transfer material is assumed to be an image for the reverse.

Figure 1:
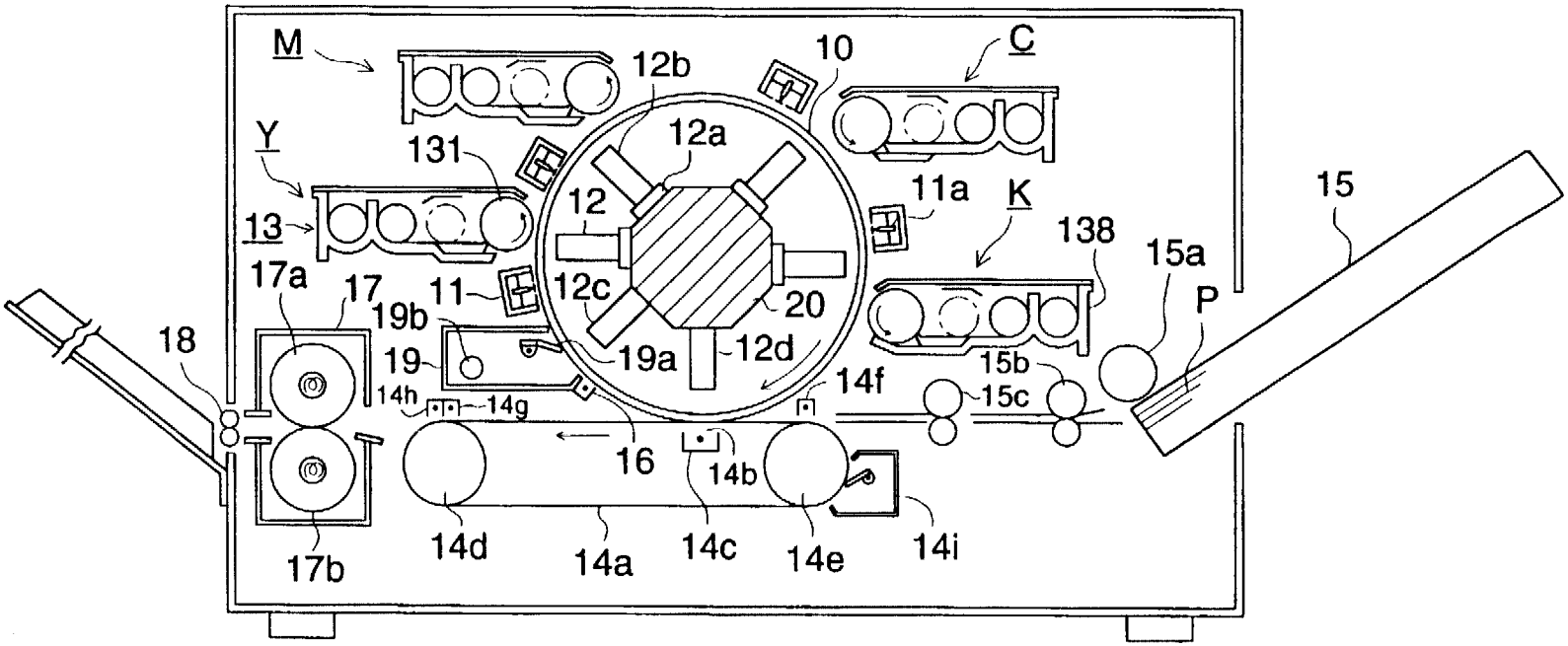
FIG. 1 is a diagram of the sectional structure of a color image forming apparatus showing the first example of an image forming apparatus.
Figure 2:
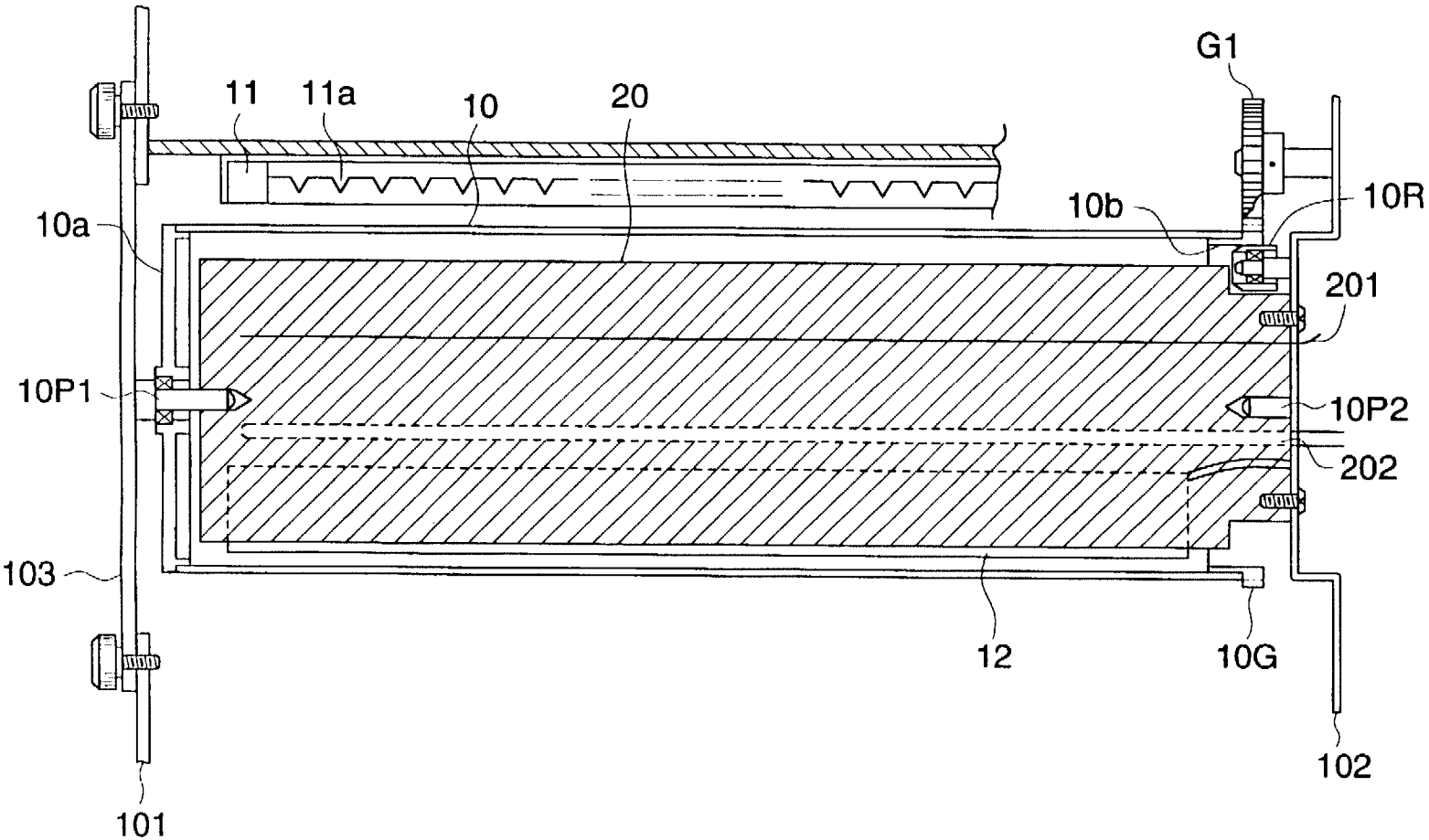
FIG. 2 is a side sectional view of an image carrier in FIG. 1.
Figure 3:
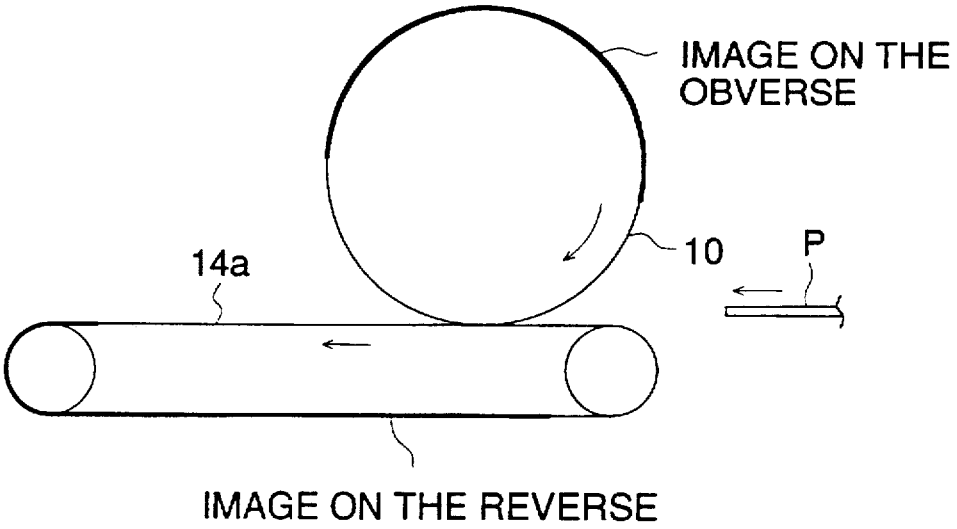
FIG. 3 is a diagram showing how a two-sided toner image relating to the first example of the image forming apparatus is formed.
Figure 4:
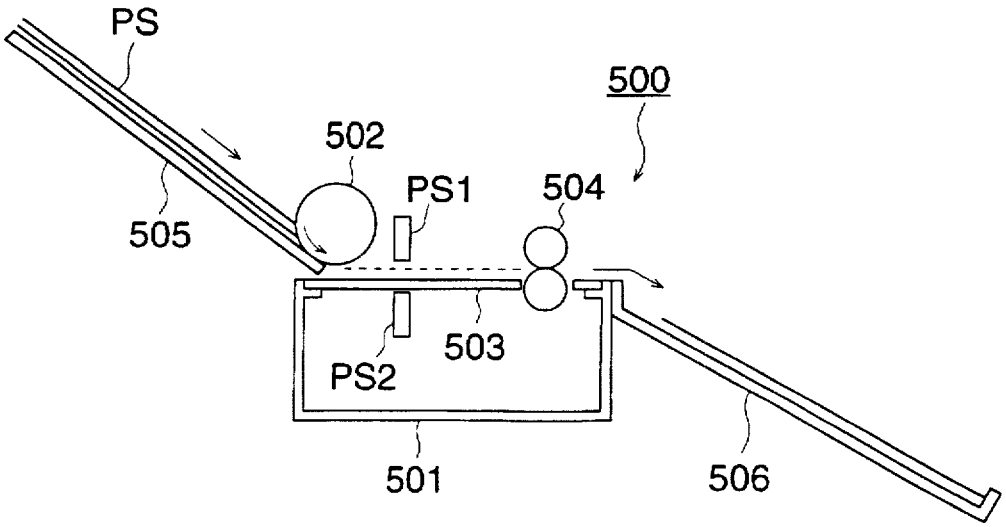
FIG. 4 is a diagram showing an example of an original image reading means.

An image forming process in the first example of an image forming apparatus of the invention and each mechanism will be explained as follows, referring to FIGS. 1–5. FIG. 1 is a diagram of the sectional structure of a color image forming apparatus showing the first example of an image forming apparatus, FIG. 2 is a side sectional view of an image carrier in FIG. 1, FIG. 3 is a diagram showing how a two-sided toner image relating to the first example of the image forming apparatus, FIG. 4 is a diagram showing an example of an original image reading means, and FIG. 5 is a block diagram of a control circuit in an image forming apparatus.

Figure 5:
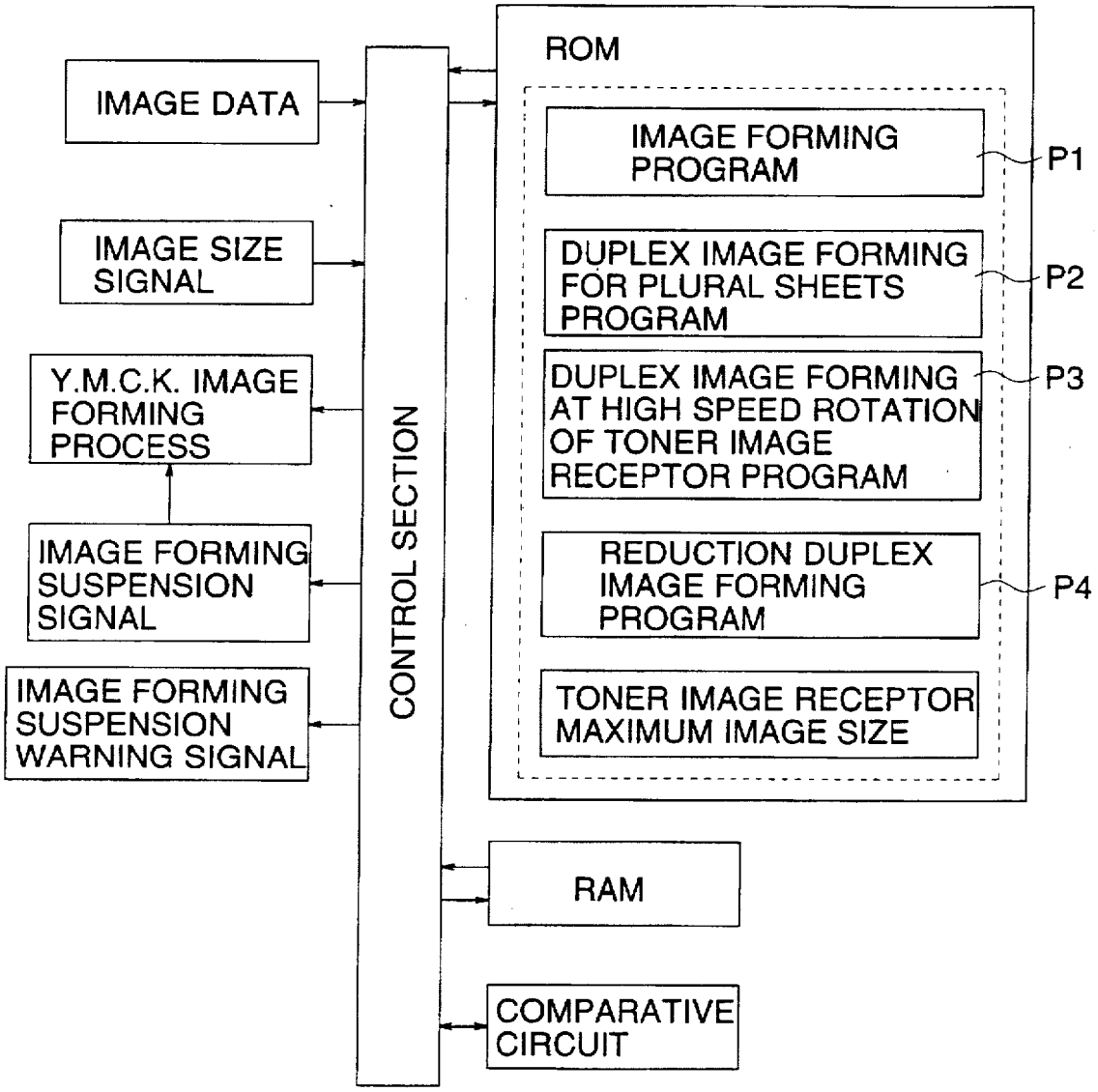
FIG. 5 is a block diagram of a control circuit in an image forming apparatus.

Image data of an original PS are read by an original image reading means shown in FIG. 4 which will be described later, then, duplex image forming program P1 stored in ROM shown in FIG. 5 is read into RAM through the control section, and the duplex image forming program P1 is executed by the control section, thus, duplex image forming shown below is conducted.

First, an image forming process in the image forming apparatus of the first example in the present embodiment will be explained as follows, referring to FIGS. 1–3.

Photoreceptor drum 10 representing an image carrier is provided, inside thereof, with a cylindrical substrate formed with a transparent member made of glass or transparent acrylic resin, for example, which is provided, on its external circumferential surface, with a transparent conductive layer, or a photoconductive layer such as an a-Si layer or an organic photoconductive layer (OPC).

The photoreceptor drum 10 is sandwiched by front flange 10*a* and rear flange 10*b*, and the photoreceptor drum 10 is supported in the way that the front flange 10*a* is supported through bearing by guide pin 10P1 provided on cover 103 that is attached on front panel 101 of the apparatus main body, and the rear flange 10*b* is externally engaged with plural guide rollers 10R provided on rear panel 102 of the apparatus main body. Gear 10G provided on the external circumferential surface of the rear flange 10*b* is engaged with driving gear G1 whose power makes the photoreceptor drum 10 rotate clockwise in the arrowed direction in FIG. 1 with the transparent conductive layer being grounded.

In the present embodiment, it is satisfactory that a certain quantity of light for exposure capable of giving an appropriate contrast exists on a photoconductive layer of a photoreceptor drum. Therefore, light transmittance of the transparent substrate of the photoreceptor drum of the invention does not need to be 100%, and characteristics of the transparent substrate allowing a certain quantity of light to be absorbed when the substrate transmits an exposure beam, are also acceptable. As a material of the translucent substrate, those obtained by polymerizing by the use of acrylic resin, especially by the use of methyl methacrylate monomer, are excellent in terms of transparency, strength, accuracy and surface properties, and are used preferably. In addition to that, it is also possible to use various kinds of translucent resins such as acryl, fluorine, polyester, polycarbonate and polyethyleneterephthalate. It is also acceptable that the substrate is colored provided that it has light transmitting properties for the exposure light. As a translucent conductive layer, there are used metallic foil which have light transmitting properties and are made of indium/tin/oxide (ITO), tin oxide, pulmbic oxide, indium oxide, copper iodide, Au, Ag, Ni or Al, and as a method of making the foil, there are utilized a vacuum evaporating method, an active reaction evaporating method, various kinds of spattering methods, various CVD methods, a dip coating method and a spray coating method. As a photoconductor layer, it is possible to use a photoconductive layer made of amorphous silicone (a-Si) alloy, a photoconductive layer made of amorphous selenium alloy, and various kinds of organic photoconductive layers (OPC).

Scorotron charging unit 11 representing a charging means is used for an image forming process for each color of yellow (Y), magenta (M), cyan (C) and black (K). It is mounted to face photoreceptor drum 10 in the direction perpendicular to the moving direction of the photoreceptor drum 10, and conducts charging operations (minus charging in this embodiment) with a control grid kept at a predetermined voltage against the above-mentioned organic photoconductor layer of the photoreceptor drum 10 and with a corona discharge with polarity identical to that of toner in which a sawtooth-shaped electrode, for example, is used as discharge electrode 11*a*, to give voltage to the photoreceptor drum 10 uniformly. As discharge electrode 11*a*, other wire electrodes may also be used.

Exposure unit 12 serving as an imagewise exposure means for each color is arranged under the condition that an exposure position on the photoreceptor drum 10 is located between the discharge electrode 11*a* of the scorotron charging unit 11 and a developing position of the developing unit 13, and on the upstream side against developing sleeve 131 in terms of rotational direction of the photoreceptor drum.

Exposure unit 12 is structured as a unit for exposure in which exposure element 12*a* composed of arrayed plural LEDs (light emitting diode) serving as imagewise exposure light emitting elements arranged in the primary scanning direction in parallel with an axis of the photoreceptor drum 10 and SELFOC lens 12*b* serving as an image formation element are attached on an unillustrated holder. Cylindrical holding member 20 which is fixed with a guide of guide pin 10P2 provided on rear panel 102 of the apparatus main body and guide pin 10P1 provided on cover 103 mounted on front panel 101, and is provided with exposure unit 12 for each color, uniform exposure unit 12*c* and with transfer-simultaneous-exposure unit 12*d*, is housed inside the substrate of the photoreceptor drum 10. Image data for each color read by a separate image reading device and stored in a memory are read out in succession from the memory and inputted into exposure unit 12 for each color as electric signals. .

As an exposure element, there is used a line-shaped one in which a plurality of light emitting elements such as other FL (phosphor luminescence), EL (electroluminescence), PL (plasma discharge) and LED (light emitting diode) are arrayed. With regard to an emission wavelength of a light emitting element used in the present embodiment, those within a range of 680–900 nm where transmittance for each toner of Y, M or C is high are normally preferable, but, a wavelength shorter than the foregoing having little transparency for color toner is also acceptable because of imagewise exposure which is conducted from the reverse side.

In the present embodiment, an order of colors used for image forming and developing units provided on a photoreceptor drum rotated in accordance with the order of colors are arranged in a way that developing unit 13 for Y and developing unit 13 for M are arranged on the left of photoreceptor drum 10 concerning the arrowed rotation direction of the photoreceptor drum 10 in FIG. 1, and developing unit 13 for C and developing unit 13 for K are arranged on the right of photoreceptor drum 10, while, scorotron charging units 11 for Y and M are arranged below developing casing 138 for developing units 13 for Y and M, and scorotron charging units 11 for C and K are arranged over developing casing 138 for developing units 13 for C and K.

The developing unit 13 representing a developing means for each color is provided with developing sleeve 131 formed with a cylinder made of non-magnetic stainless steel or aluminum having a wall thickness of 0.5 mm–1 mm and outside diameter of 15–25 mm, for example, which respectively stocks single-component or two-component developing agents of yellow (Y), magenta (M), cyan (C) or black (K), and rotates in the same direction as in the photoreceptor drum 10 at the developing position while keeping a predetermined distance from the circumferential surface of the photoreceptor drum 10.

There is conducted reversal development in which the developing unit 13 is kept by unillustrated stopper rolls to be out of contact with photoreceptor drum 10, keeping a predetermined clearance of 100 μm–1000 μm, for example, from the photoreceptor drum 10, and developing bias of D.C. voltage or of D.C. voltage plus A.C. voltage AC is impressed on the developing sleeve 131 for developing operation made by developing unit 13 for each color, then jumping development by means of single-component or two-component developing agents contained in the developing unit is conducted, and D.C. bias of the same polarity (minus polarity in the present embodiment) as in toner is impressed on the negatively charged photoreceptor drum 10 whose transparent conductive layer is grounded so that toner may be stuck on the exposed portion. In this case, accuracy of the clearance for development is required to be about 20 μm or less for preventing unevenness of images.

The developing unit 13 for each color mentioned above conducts, with toner having the same polarity as in a charging electrode (toner with minus polarity in this embodiment because a photoreceptor drum is charged negatively) under the non-contact condition, the reversal development on an electrostatic latent image formed on photoreceptor drum 10 by imagewise exposure based on charging by the scorotron charging unit 11 and on exposure unit 12 through a non-contact developing method with a impressed developing bias voltage.

As an original image, an image read out by image pickup element of an image reading device which is separate from the present apparatus, or an image edited by a computer, is recorded and stored in a memory temporarily as image data for each color of Y, M, C and K.

Upon the start of image recording, gear 10G provided on rear flange 10*b* of photoreceptor drum 10 is rotated through gear G1 for driving when an unillustrated photoreceptor driving motor starts to rotate the photoreceptor drum 10 in the arrowed clockwise direction, and concurrently with this, scorotron charging unit 11 for Y arranged below developing casing 138 of developing unit 13 for yellow (Y) starts applying voltage on the photoreceptor drum 10 through a charging operation, on the left of the photoreceptor drum 10.

After being given voltage, the photoreceptor drum 10 is subjected to exposure of electric signals corresponding to the first color signals, namely, image data of Y at the exposure unit 12 for Y, thus, an electrostatic latent image corresponding to an image of Y in an original image is formed on a photoconductive layer on the drum through rotational scanning thereof.

The latent image mentioned above is subjected, by developing unit 13, to reversal development on condition of non-contact of developing agents on the developing sleeve, and a toner image of yellow (Y) is formed accordingly as the photoreceptor drum 10 rotates.

Then, voltage is applied on the toner image of yellow (Y) on the photoreceptor drum 10 by scorotron charging unit 11 of magenta (M) arranged below developing casing 138 of developing unit 13 of magenta (M) on yellow (Y) on the left of the photoreceptor drum 10 through the charging operation of the scorotron charging unit. Then, there is conducted the exposure by means of electric signals corresponding to the second color signals of exposure unit 12 of M, namely to image data of M. Thus, a toner image of magenta (M) is superposed in succession on the toner image of yellow (Y) through non-contact reversal development conducted by developing unit 13 of M.

Through the same process as in the foregoing, a toner image of cyan (C) corresponding to the third color signals is formed by scorotron charging unit 11 of cyan (C) arranged over developing casing 138 of developing unit 13 of cyan (C) on the right of the photoreceptor drum 10, exposure unit 12 of C and by developing unit 13 of C, and a toner image of black (K) corresponding to the fourth color signals is formed by scorotron charging unit 11 of black (K) arranged over developing casing 138 of developing unit 13 of black (K) located below C. So that both toner images are superposed, Thus, a color toner image is formed on the circumferential surface of the photoreceptor drum 10 while it makes one turn (toner image forming means).

Exposure to an organic photoconductive layer of the photoreceptor drum 10 by means of these Y, M, C and exposure unit 12 is conducted from the inside of the drum through the transparent substrate. Therefore, exposure for each of images corresponding to the second color, third color and fourth color can be conducted without being influenced by the toner image formed previously, thus, latent images which are the same as the image corresponding to the first color signal can be formed. Incidentally, with regard to stabilization of the temperature or prevention of the temperature rise in the photoreceptor drum 10 against heat emission of each exposure optical system 12, it is possible to control up to the level where no obstacle is provided, by using a material with excellent heat conductivity for the holding member 20, using heater 201 when a temperature is low, and by using heat pipe 202 which radiates heat to the outside when a temperature is high.

Owing to the image forming process mentioned above, a superposed color toner image which is to be an image for the reverse is formed on the photoreceptor drum 10 (first image carrying means). The image for the reverse which is the superposed color toner image on the photoreceptor drum 10 is spread, in transfer area **14*b*, between driving roller 14*d* and driven roller 14*e* by transfer unit 14*c* where voltage with polarity (plus polarity in the present embodiment) opposite to that of toner is impressed, and then is transferred collectively onto toner image receptor 14*a* (second image carrying means) provided to be close to or to be in contact with the photoreceptor drum 10. In this case, uniform exposure is conducted simultaneously with transfer by exposure unit 12*d*** employing a light emitting diode, for example, so that satisfactory transfer may be performed.

Toner remaining on the photoreceptor drum 10 after the transfer is subjected to neutralizing made by image carrier AC neutralizing unit 16, and then is conveyed to cleaning unit 19 where the toner is scraped off for cleaning by cleaning blade **19*a* made of rubber material which is in contact with the photoreceptor drum 10. Further, for eliminating hysteresis caused on the photoreceptor during a period up to the moment of the previous print, the circumferential surface of the photoreceptor is subjected to neutralizing by means of exposure made by pre-charging uniform exposure unit 12*c*** employing a light emitting diode, for example, so that charging for the previous print is removed and the following color image forming for an image for the obverse is conducted.

Being synchronized, in transfer area **14*b*, with an image for the reverse that is formed on the toner image receptor 14*a*, a superposed color toner image representing an image for the obverse is formed on the photoreceptor drum 10** in the same manner as in above-mentioned color image forming process. The image for the obverse formed in this case needs to be modified in terms of image data so that it may represent a mirror image of the image for the reverse on the image carrier.

Recording sheet P representing a transfer material is fed out of paper feed cassette 15 which is a transfer material storing means by feed out roller **15*a*, and then is fed by feed roller 15*b* to be conveyed to timing roller 15*c***.

Being driven by the timing roller **15*c*, the recording sheet P is conveyed to transfer area 14*b*, with a color toner image representing an image for the obverse carried on the photoreceptor drum 10 and a color toner image representing an image for the reverse carried on the toner image receptor 14*a* both of which are synchronized. In this case, the recording sheet P is sheet-charged by sheet charging unit 14*f* to the same polarity as in toner, and is conveyed to transfer area 14*b* while being adsorbed to the toner image receptor 14*a***. Since the recording sheet is charged to the same polarity as of toner, it is prevented that the recording sheet attracts the toner image on the toner image receptor and the toner image on the image carrier, thus, disturbance of toner images is prevented.

The image for the obverse formed on the circumferential surface of the photoreceptor drum 10 is collectively transferred onto the recording sheet P by transfer unit **14*c* on which the voltage with polarity opposite to that of toner (plus polarity in the present embodiment) is impressed (first transfer means). In this case, the image for the reverse formed on the circumferential surface of the toner image receptor 14*a* is not transferred onto the recording sheet P but stays on the toner image receptor 14*a*. Next, the image for the reverse formed on the circumferential surface of the toner image receptor 14*a* is collectively transferred onto the lower side of the recording sheet P by reverse side transfer unit 14*g* on which the voltage with polarity opposite to that of toner (plus polarity in the present embodiment) is impressed (second transfer means). In the case of transfer made by the transfer unit 14*c*, uniform exposure is conducted by exposure unit 12*d*, provided in the photoreceptor drum 10, facing transfer unit 14*c*** and employing a light emitting diode, for example, so that satisfactory transfer may be performed.

Since color toner images are superposed with each other, it is preferable, for the collective transfer, that toner on the upper layer and that on the lower layer both on the toner layer are of the same amount of charging and are charged to the same polarity. However, in the duplex image forming in which a color toner image formed on toner image receptor **14*a*** is reversed in terms of polarity by corona charging, or a color toner image formed on an image carrier is reversed in terms of polarity by corona charging, toner in the lower layer can not be charged sufficiently to the same polarity, resulting in defective transfer, which is not preferable.

It is preferable to collectively transfer, onto the toner image receptor **14*a*** without changing the polarity, the color toner image with the same polarity formed by repeating reversal development on the image carrier and by superposing the images, and to collectively transfer the color toner image onto the recording sheet P, because this process contributes to an improvement of transferability in the forming of an image for the reverse. Even for the forming of an image for the obverse, it is preferable to collectively transfer, onto the recording sheet P without changing the polarity, the color toner image with the same polarity formed by repeating reversal development on the image carrier and by superposing the images, because this process contributes to an improvement of transferability in the forming of an image for the obverse.

For the reasons mentioned above, there is preferably employed, in color image forming, a duplex image forming method in which a color toner image is formed on the obverse side of a transfer material under the operation of the first transfer means through above-mentioned image forming method for an image for the obverse and that for the reverse, and then a color toner image is formed on the reverse side of the transfer material under the operation of the second transfer means.

The toner image receptor **14*a*** is an endless rubber belt having a thickness of 0.5–2.0 mm which is of a two-layer structure in which the outer surface of a semi-conductive substrate having a resistance value of $10^8$–$10^{12}$ Ω·cm made of silicone rubber or urethane rubber and that of a rubber substrate are subjected to fluorine coating in thickness of 5–50 μm as a toner filming preventing layer. This layer also needs preferably to be semi-conductive. It is also possible to use semi-conductive polyester, polystyrene and polyethyleneterephthalate each having a thickness of 0.1–0.5 mm, in place of the rubber belt substrate.

The recording sheet P having on its both sides color images is neutralized by sheet separation AC neutralizing unit 14*h* for separating a transfer material, then is separated from the toner image receptor 14*a*, and is conveyed to fixing unit 17 serving as a fixing means composed of two rollers each having therein a heater. Being applied with heat and pressure in the area between fixing roller 17*a* and pressure roller 17*b*, toner sticking to the obverse side and that sticking to the reverse side both of the recording sheet P are fixed, thus, the recording sheet P on both sides of which images have been recorded is conveyed by exit roller 18 to be ejected to a tray which is positioned outside the apparatus.

Toner staying on the circumferential surface of the toner image receptor 14*a* after the transfer is removed by toner image receptor cleaning unit 14*i*. Toner staying on the circumferential surface of the photoreceptor drum 10 after the transfer, on the other hand, is subjected to neutralizing made by image carrier AC neutralizing unit 16, then arrives at cleaning unit 19 where it is scraped down in the cleaning unit 19 by cleaning blade 19*a* which is made of rubber material and is in contact with the photoreceptor drum 10, and is collected into an unillustrated toner container by screw 19*b*. The photoreceptor drum 10 from which the remaining toner has been removed by the cleaning unit 19 is charged uniformly by scorotron charging unit 11 of Y to be ready for the following image forming cycle.

In the method mentioned above, due to collective transfer of superposed color images, color doubling, scattered toner and frictional damage of toner on a color image on the toner image receptor are hardly caused, and excellent duplex color image forming with less deterioration of images can be achieved.

Figure 6:
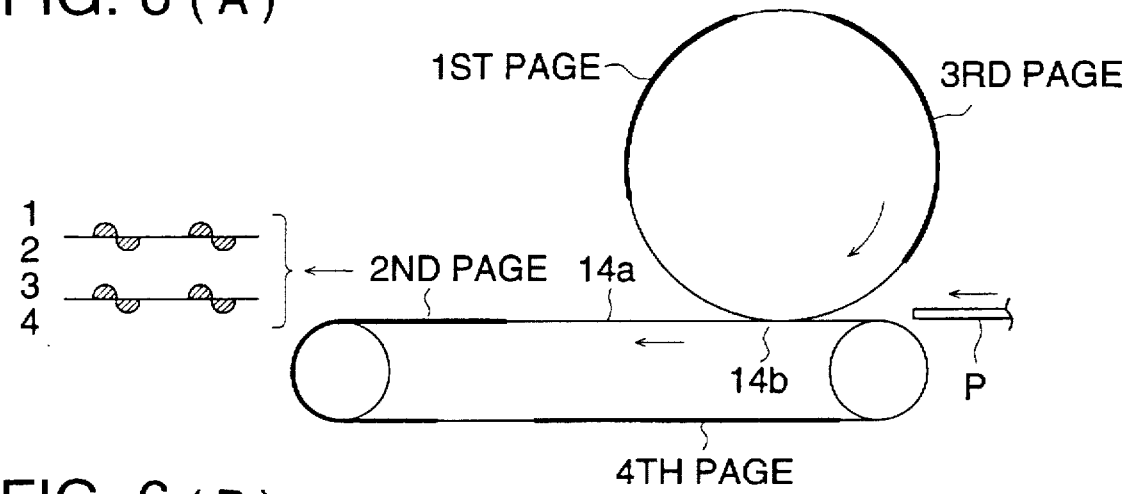
FIGS. 6(A)–6(C) represent a diagram showing duplex image forming and an ejection method relating to the second example.
Figure 6:
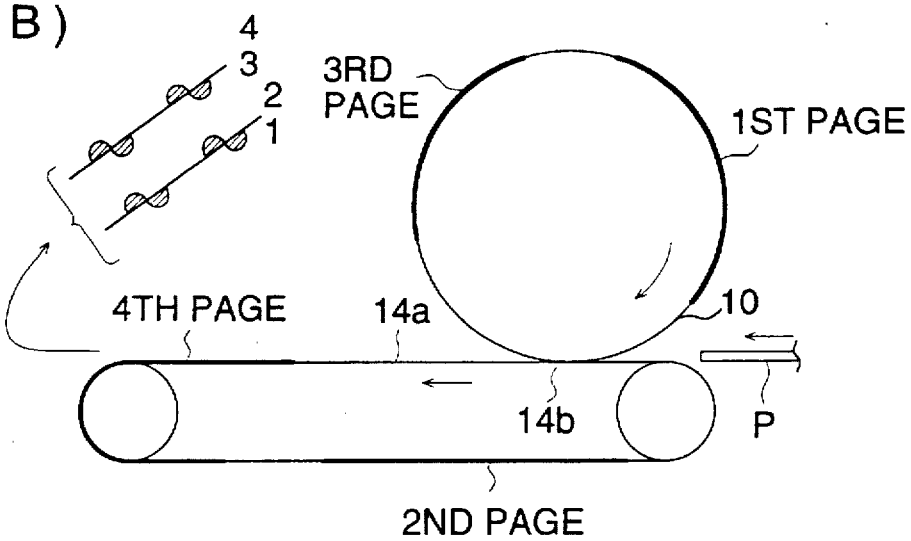
Figure 6:
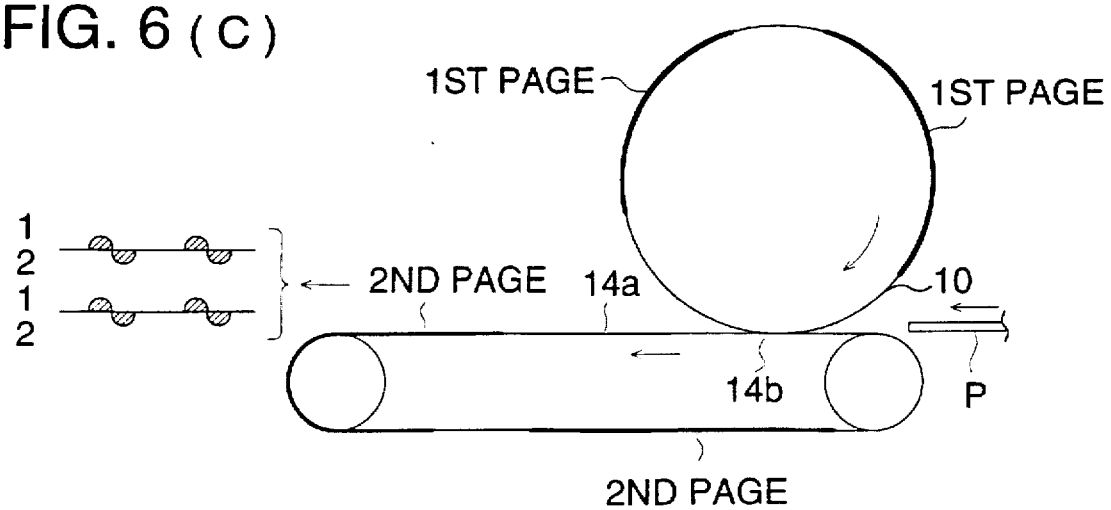

Next, a duplex image forming method related to the second example will be explained as follows, referring to FIG. 6 and FIGS. 4 and 5. FIG. 6 is a diagram showing duplex image forming and an ejecting method. FIG. 6(A) is a diagram showing the first example of the duplex image forming and the ejecting method, FIG. 6(B) is a diagram showing the second example of the duplex image forming and the ejecting method and FIG. 6(C) is a diagram showing the third example of the duplex image forming and the ejecting method.

Image data of original PS are read by original image reading means shown in FIG. 4, plural sheet duplex image forming program P2 stored in ROM shown in FIG. 5 is read into RAM through a control section, and the plural sheet duplex image forming program P2 is executed by the control section, thus the duplex image forming shown below is conducted.

An original image reading means is shown in FIG. 4 and a block diagram of a control circuit of a color image forming apparatus is shown in FIG. 5. Original image reading unit 500 representing an original image reading means is composed of reading unit main body 501, original storing tray 505 that stores original PS, original feed-out roller 502, transparent plate 503, original conveyance roller 504, original ejection tray 506, and line-shaped original image reading sensors PS1 and PS2 which are provided to sandwich transparent plate 503 between them and read original images from the upper position and from the lower position, and the original image reading unit 500 is connected to the control section with signal lines incorporated in an external equipment or in the color image forming apparatus explained above.

When original PS fed out by original feed-out roller 502 passes through the transparent plate 503, the original image reading sensors PS1 and PS2 which are provided at the upper position and the lower position to sandwich transparent plate 503 between them read image data on both sides of the original PS, and the image length of the original PS in its feed-out direction is discriminated (image size discrimination) by detection of the leading edge and the trailing edge of the original PS. Though a pair of sensors located respectively at the upper position and the lower position read images and discriminate the image size in the present embodiment, it is also possible to provide a plurality of sensors corresponding respectively to image data reading and image size discrimination. For example, plural sensors corresponding respectively may be used to discriminate the image size and then to read the image data.

Image data and image size of a bundle of original PS are read by the original image reading sensors PS1 and PS2 and are stored in RAM through the control section.

The duplex image forming process explained above is conducted by comparing the image size of original PS with the maximum image size which is stored in ROM and can be covered by a toner image receptor. For example, when image data on both sides for each of two sheets of original PS are read, and if the maximum image size which can be covered by a toner image receptor is discriminated as A-3 size and image size of original PS is discriminated to be A-4 size, an image of the fourth page is formed first and an image of the second page is formed later, both on the toner image receptor 14*a* by the use of photoreceptor drum 10 as shown in FIG. 6(A), and then an image of the third page and an image of the first page are formed on the photoreceptor drum 10 by synchronizing the images of the fourth page and the second page both formed on the toner image receptor 14*a* with those of the third and first pages at transfer area 14*b*, thus images on both sides are transferred and fixed on each of the recording sheets P which are ejected in a manner that the fourth page is ejected to be lowest and the first page is ejected to be uppermost.

Further, an image of the second page is formed first and an image of the fourth page is formed later, both on the toner image receptor 14*a* by the use of photoreceptor drum 10 as shown in FIG. 6(B), and then an image of the first page and an image of the third page are formed on the photoreceptor drum 10 by synchronizing the images of the second page and the fourth page both formed on the toner image receptor 14*a* with those of the first and third pages at transfer area 14*b*, thus images on both sides are transferred and fixed on each of the recording sheets P which are ejected in a manner that the first page is ejected to be lowest and the fourth page is ejected to be uppermost.

Further, as shown in FIG. 6(C), image data of the same original in A-4 size are formed by the use of the photoreceptor drum 10 on the toner image receptor 14*a* so that an image of the second page is formed twice, and then two images of the first page are formed on the photoreceptor drum 10 by synchronizing two images of the second page formed on the toner image receptor 14*a* with those formed on the photoreceptor drum 10 at the transfer area 14*b*. Thus images on both sides are transferred and fixed on each of the two recording sheets P which are ejected in a manner that the second page is ejected to be lowest and the first page is ejected to be uppermost.

When printing the same page on sheets of odd number, image data are modified so that the reverse side may agree with the obverse side and are outputted for duplex image forming.

When the image size of original PS is discriminated to be A-3 for the maximum image size of A-3 capable of being covered by a toner image receptor, the duplex image forming for one sheet mentioned above is conducted.

Owing to the foregoing, an efficiency of using a toner image receptor representing the second image carrier means is improved and speedup of the printing speed for duplex image forming can be achieved.

Figure 7:
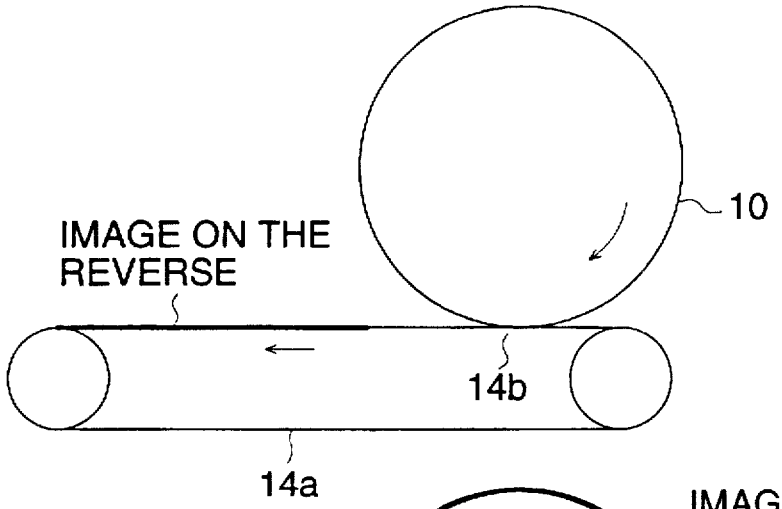
FIGS. 7(A)–7(C) represent a diagram showing a duplex image forming method relating to the third example.
Figure 7:
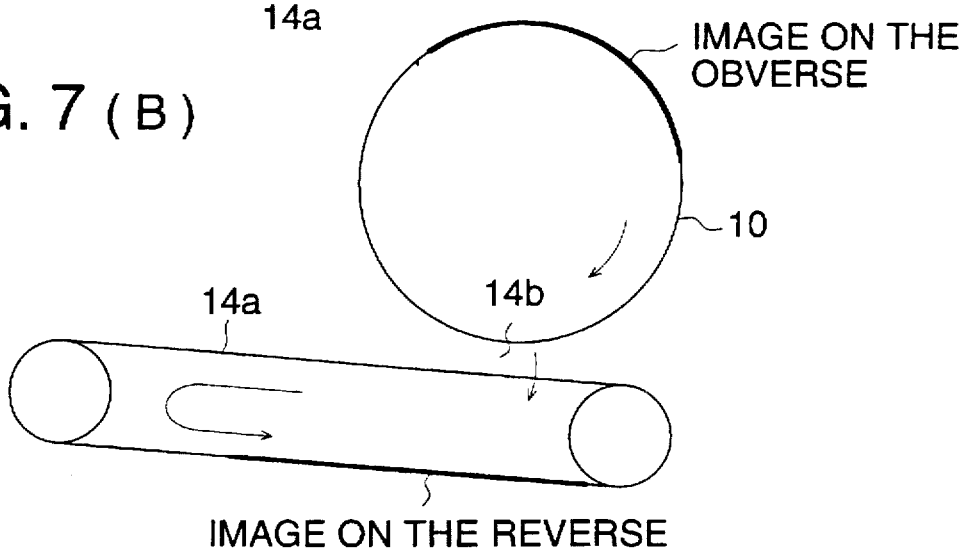
Figure 7:
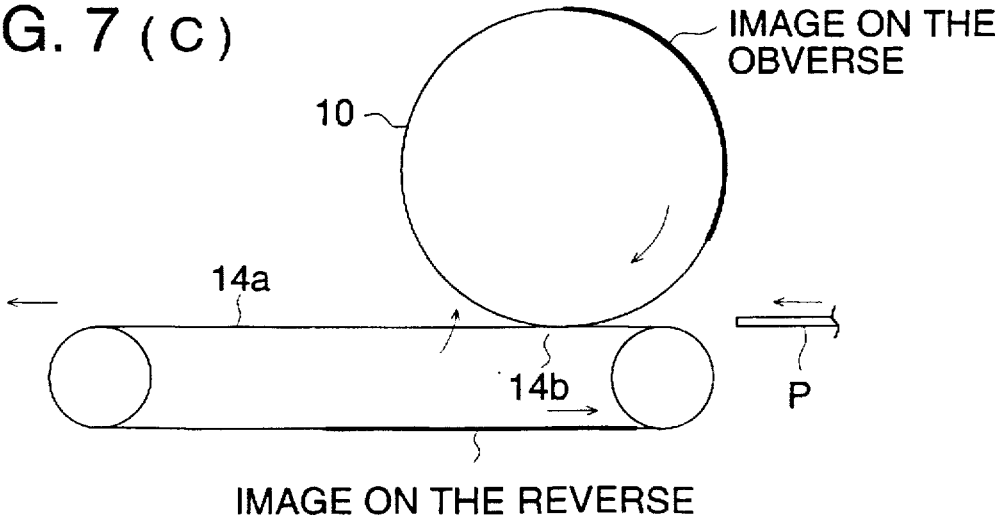
Figure 8:
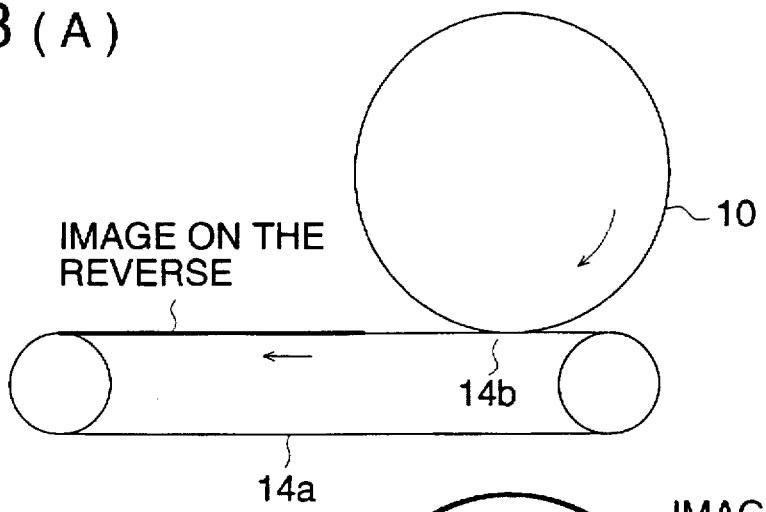
FIGS. 8(A)–8(C) represent a diagram showing a duplex image forming method relating to the fourth example.
Figure 8:
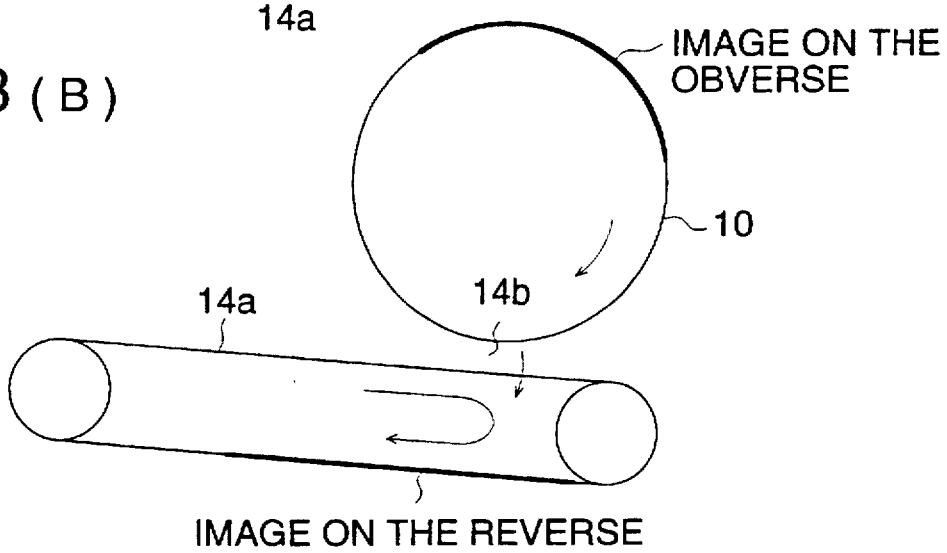
Figure 8:
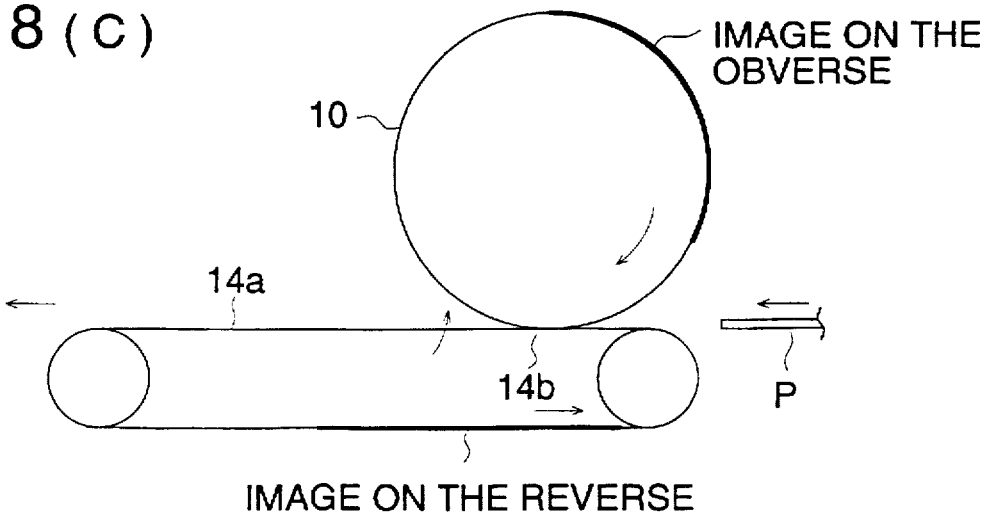

Next, a duplex image forming method relating to the third and fourth examples will be explained as follows, referring to FIGS. 7 and 8 and FIGS. 4 and 5. FIG. 7 is a diagram showing a duplex image forming method relating to the third example, FIG. 7(A) is a diagram showing how an image for the reverse is formed, FIG. 7(B) is a diagram showing how an image for the obverse is formed, and FIG. 7(C) is a diagram showing how duplex image forming is conducted. FIG. 8 is a diagram showing a duplex image forming method relating to the fourth example, FIG. 8(A) is a diagram showing how an image for the reverse is formed, FIG. 8(B) is a diagram showing how an image for the obverse is formed, and FIG. 8(C) is a diagram showing how duplex image forming is conducted.

Even in the present example, there is conducted duplex image forming based on the same duplex image forming process as in those explained by FIGS. 1–3 mentioned above.

Image data of original PS are read by original image reading means shown in FIG. 4 explained above, high speed toner image receptor rotation duplex image forming program P3 stored in ROM shown in FIG. 5 is read into RAM through a control section, and the high speed toner image receptor rotation duplex image forming program P3 is executed by the control section, thus the duplex image forming shown below is conducted.

As explained, referring to FIG. 4, when original PS fed out by original feed-out roller 502 passes through the transparent plate 503, the original image reading sensors PS1 and PS2 which are provided at the upper position and the lower position to sandwich transparent plate 503 between them read image data on both sides of the original PS, and the image length of the original PS in its feed-out direction is discriminated (image size discrimination) by detection of the leading edge and the trailing edge of the original PS. Though a pair of sensors located respectively at the upper position and the lower position read images and discriminate the image size in the present embodiment, it is also possible to provide a plurality of sensors corresponding respectively to image data reading and image size discrimination. For example, plural sensors corresponding respectively may be used to discriminate the image size and then to read the image data.

Image data and image size of a bundle of original PS are read by the original image reading sensors PS1 and PS2 and are stored in RAM through the control section.

The duplex image forming process explained above is conducted by comparing the image size of original PS with the maximum image size which is stored in ROM and can be covered by a toner image receptor, using a comparing circuit. For example, when the maximum image size which can be covered by a toner image receptor is discriminated as A-3 size and image size of original PS is discriminated to be A-4 size, an image for the reverse is formed first on the toner image receptor 14*a* by the use of photoreceptor drum 10 as shown in FIG. 7(A).

Next, an image for the obverse is formed on the photoreceptor drum 10 as shown in FIG. 7(B). In this case, toner image receptor 14*a* is moved away from the photoreceptor drum 10, and the toner image receptor 14*a* is rotated in the regular rotational direction for the toner image receptor 14*a* (counterclockwise rotational direction in FIG. 7(B)) shown with an arrow in FIG. 7(B) faster than the speed of rotation for image forming until an image for the reverse on the toner image receptor 14*a* is synchronized with an image for the obverse on the photoreceptor drum 10 at the transfer area 14*b*.

Further, it is preferable for achieving on effective and high-speed image forming that a revolution of toner image receptor 14*a* at high speed rotation is controlled according to the discriminated image size.

As shown in FIG. 7(C), further, the toner image receptor 14*a* is brought into contact with the photoreceptor drum 10 again, then, an image for the obverse in A-4 size formed on the photoreceptor drum 10 is synchronized with an image for the reverse formed on the toner image receptor 14*a* at the transfer area 14*b*, and both images for both sides are transferred and fixed on recording sheet P which is then ejected.

Further, in the duplex image forming process explained above which is conducted when an image size of original PS is compared with the maximum image size which is stored in ROM and is capable of being covered by a toner image receptor by a comparing circuit, when the maximum image size capable of being covered by the toner image receptor is discriminated to be A-3 size and an image size of original PS is discriminated to be A-4 size, for example, an image for the reverse is formed on the toner image receptor 14*a* first by the use of the photoreceptor drum 10 as shown in FIG. 8(A).

Then, an image for the obverse is formed on the photoreceptor drum 10 as shown in FIG. 8(B). In this case, toner image receptor 14*a* is moved away from the photoreceptor drum 10, and the toner image receptor 14*a* is rotated in the reverse rotational direction for the toner image receptor 14*a* (clockwise rotational direction in FIG. 8(B)) shown with an arrow in FIG. 8(B) faster than the speed of rotation for image forming until an image for the reverse on the toner image receptor 14*a* is synchronized with an image for the obverse on the photoreceptor drum 10 at the transfer area 14*b*.

As shown in FIG. 8(C), further, the toner image receptor 14*a* is brought into contact with the photoreceptor drum 10 again, then, an image for the obverse in A-4 size formed on the photoreceptor drum 10 is synchronized with an image for the reverse formed on the toner image receptor 14*a* at the transfer area 14*b*, and both images for both sides are transferred and fixed on recording sheet P which is then ejected.

In FIGS. 7 and 8, the toner image receptor 14 is separated from the photoreceptor drum 10 when the toner image receptor 14 is run at a high speed in order to shorten a period of time from formation of an image for the reverse to formation of an image for the obverse. In the image forming apparatus shown in FIG. 1, however, it is possible to run both the photoreceptor drum 10 and the toner image receptor 14 at a high speed while the toner image receptor 14 is in contact with the photoreceptor drum 10, or to run only the toner image receptor 14 while the speed of the photoreceptor drum 10 remains unchanged.

Owing to the foregoing, an efficiency of usage of the toner image receptor representing the second image carrier can be improved, and speedup of the printing speed for duplex image forming can be achieved, in particular.

Figure 9:
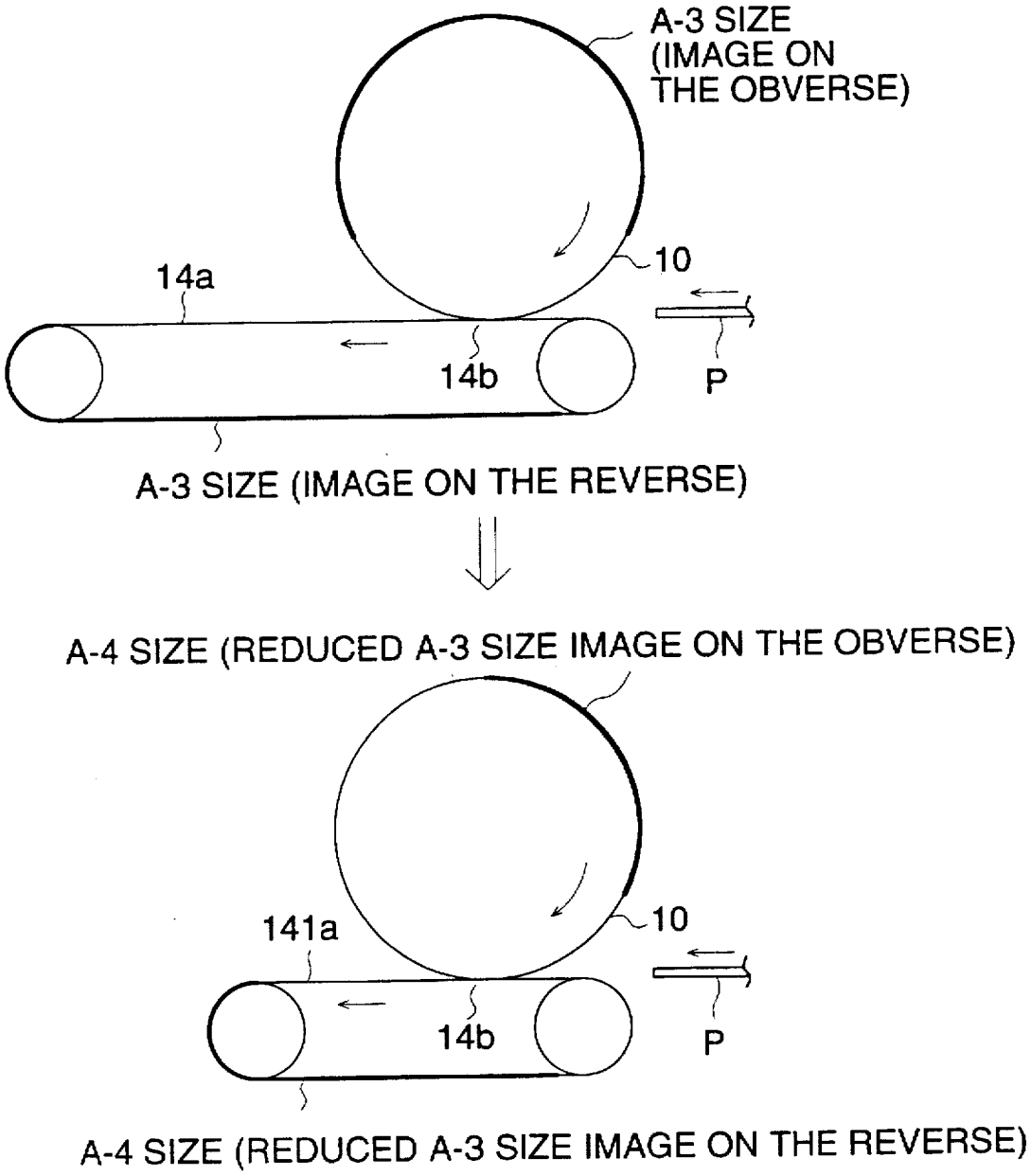
FIG. 9 is a diagram showing a toner image receptor relating to the fifth example.

Next, a duplex image forming apparatus relating to the fifth example will be explained as follows, referring to FIG. 9 and FIGS. 4 and 5. FIG. 9 is a diagram showing a toner image receptor.

Even in the present example, formation of images on both sides is conducted through the same duplex image forming process as in those explained referring to FIGS. 1–3. In the image forming apparatus of the present example, however, toner image receptor 141*a* capable of covering A-4 size which is half that of A-3 is used in place of the toner image receptor 14*a* capable of covering A-4 size, for the maximum image size, for example, A-3 which can be covered by aforesaid toner image receptor, for the purpose of making an apparatus small, as shown in FIG. 9. With regard to a circumference length of the toner image receptor 14*a*, A-4 size requires a belt having a length of only 230–300 mm, while A-3 size require a belt having a length of 450–600 mm. Owing to this, a color image forming apparatus can be made small drastically.

The duplex image forming process explained above is conducted by comparing the image size of original PS with the maximum image size which is stored in ROM and can be covered by a toner image receptor, using a comparing circuit. For example, when the maximum image size which can be covered by a toner image receptor is discriminated as A-4 size and image size of original PS is discriminated to be A-3 size, a control section outputs an image formation suspension signal for suspending an image forming process of a color image forming apparatus to suspend the image forming process, or outputs an image formation suspension warning signal to a color image forming apparatus main body or to an operation section provided on an external equipment to warn, as shown in FIG. 5. Or, both of them can be done simultaneously.

The duplex image forming process explained above is conducted by comparing the image size of original PS with the maximum image size which is stored in ROM and can be covered by a toner image receptor, using a comparing circuit. For example, when the maximum image size which can be covered by a toner image receptor is discriminated as A-4 size and image size of original PS is discriminated to be A-3 size, reduction duplex image forming program P4 is read from ROM into RAM through a control section, the reduction duplex image forming program P4 is executed by the control section, an image for the reverse is formed on the toner image receptor 141*a* from the photoreceptor drum 10, on a basis of reduction from A-3 size of an original image to A-4 size, and the image for the reverse formed on the toner image receptor 141*a* is synchronized with the reduction image of A-4 size representing an image for the obverse of A-3 size original image formed on the photoreceptor drum 10 again at the transfer area 14*b*, thus, duplex image forming is conducted on recording sheet P in the same way mentioned above.

In the above example, when the maximum image size which can be covered by a toner image receptor is discriminated as A-4 size and image size of original PS is discriminated to be A-3 size, for example, it is also possible to form on the toner image receptor 141*a* an image for the reverse only for a portion of the maximum image size capable of being covered by a toner image receptor, for a portion of an A-4 size length in this case, and to conduct duplex image forming for the image for the reverse and the A-4 size reduction image representing the image for the obverse formed on the photoreceptor drum 10, or the image for the obverse for only a portion of an A-4 size length.

Owing to the foregoing, duplex image forming has become possible even by a toner image receptor representing the small-sized second image carrying means, and thereby a color image forming apparatus can be made small by elimination of unnecessary image forming and by the small-sized second image carrying means, and speedup of the printing speed for duplex image forming can be achieved by the small-sized second image carrying means.

Figure 10:
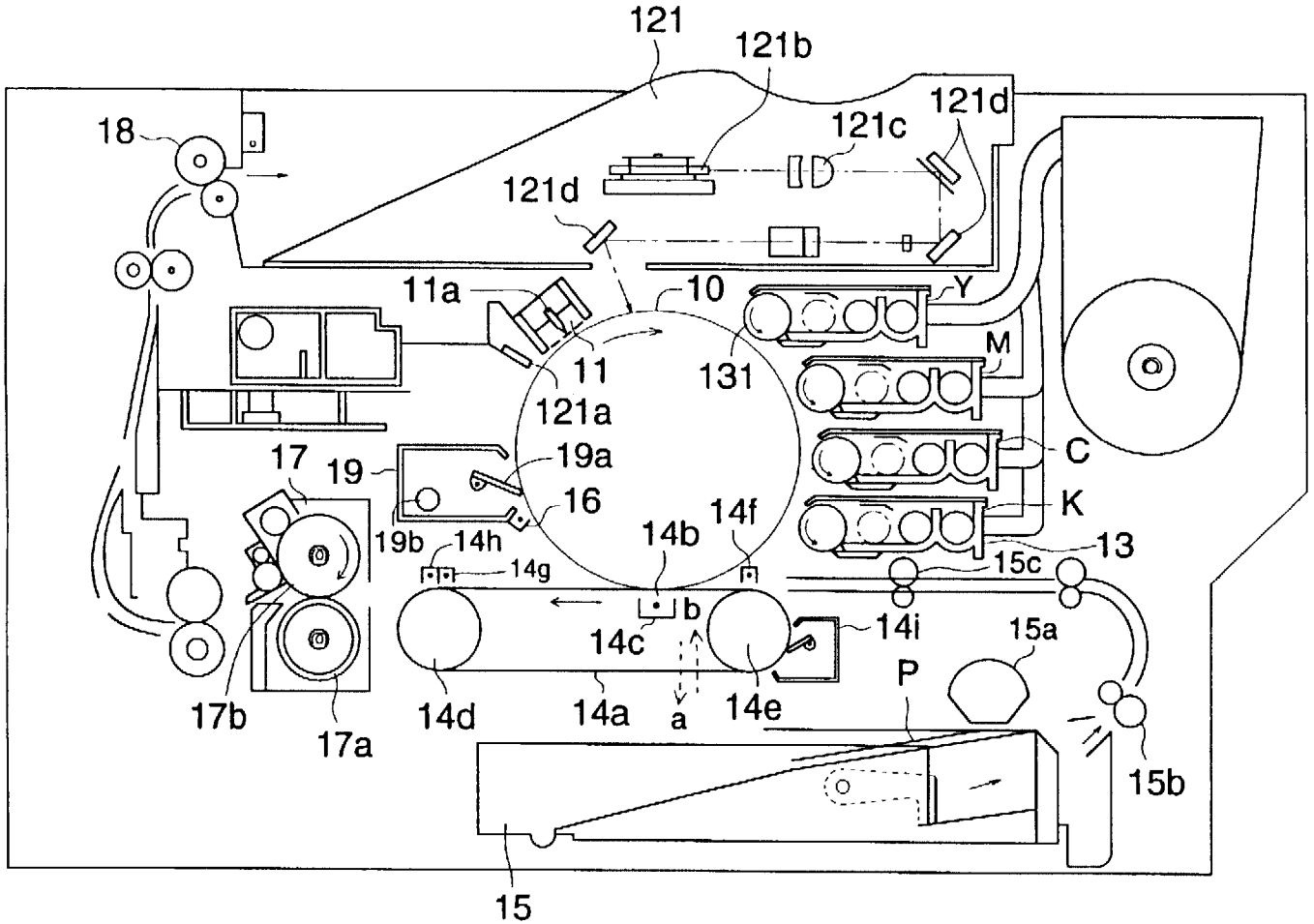
FIG. 10 is a diagram of the sectional structure of the sixth example of an image forming apparatus.
Figure 11:
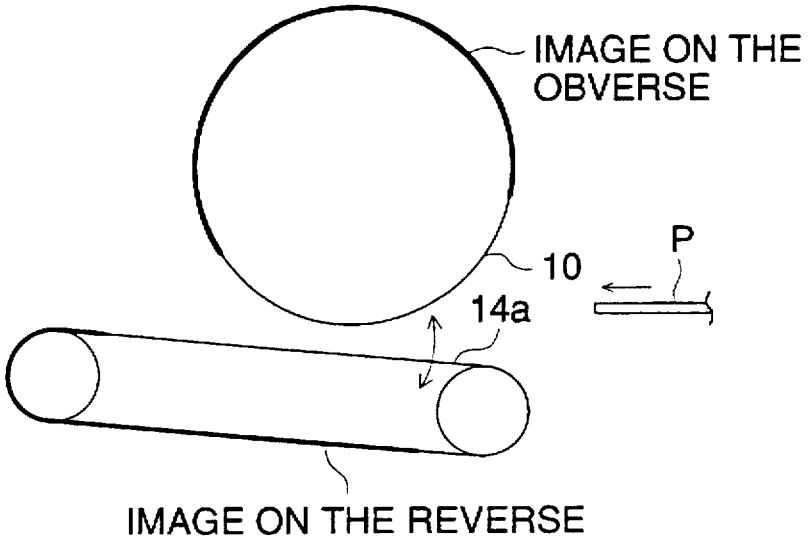
FIG. 11 is a diagram showing how two-sided toner images are formed relating to the sixth example of an image forming apparatus.

An image forming process and each mechanism in the sixth example of an image forming apparatus in the present embodiment will be explained, referring to FIGS. 10 and 11. FIG. 10 is a sectional structure diagram of the image forming apparatus, and FIG. 11 is a diagram showing how two-sided toner images are formed in the image forming apparatus. In the drawing, portions having the same functions or structures as those in the image forming apparatus in the first example mentioned above are given the same symbols.

Toner image receptor 14*a* trained around driving roller 14*d* and driven roller 14*e* is swiveled around the center of the driving roller 14*d* in the direction shown with a dotted line "a" in FIG. 10 to be separated from photoreceptor drum 10. Under this condition, image forming stated below is conducted.

The photoreceptor drum 10, representing an image carrier is provided in its inside with a cylindrical substrate which is provided on its circumferential surface with a photoconductive layer such as a conductive layer, an a-Si layer or an organic photoconductive layer (OPC), and it is rotated in the clockwise direction shown with an arrow in FIG. 10 under the condition that it is grounded.

The photoreceptor drum 10, representing an image carrier is rotated, and for the purpose of eliminating hystersis on the photoreceptor drum 10, it is subjected to uniform exposure conducted by uniform exposure unit 121*a* representing a means for neutralizing before charging, by a light emitting diode, for example, thus, the circumferential surface of the photoreceptor is neutralized, and charges for the preceding printing are eliminated.

Charging operation (minus charging in the present embodiment) is conducted by a control grid in which scorotron charging unit 11 representing a charging means is kept to a predetermined level of voltage against the organic photoconductive layer of the photoreceptor drum 10 and by corona discharging made by discharge electrode 11*a*, to give uniform voltage to the photoreceptor drum 10.

The photoreceptor drum 10 is subjected, after being charged on its circumferential surface by scorotron charging unit 11, to imagewise exposure conducted by exposure unit 121 representing an exposure means based on image signals, thus, a latent image is formed on the photoreceptor drum 10.

Exposure unit 121 serving as an imagewise exposure means is composed of a semi-conductor laser representing an unillustrated light emitting diode, rotating polygon mirror 121*b* which turns the laser beam emitted from the semi-conductor laser for scanning, fθ lens 121*c* and reflection mirror 121*d*. A laser beam emitted from the unillustrated semi-conductor laser is turned for scanning by the rotating polygon mirror 121*b*, and it goes through the fθ lens 121*c* and reflection mirror 121*d* to give imagewise exposure based on image signals on rotating photoreceptor drum 10 in the primary scanning direction, thus, a latent image is formed on the photoreceptor drum 10.

Around the photoreceptor drum 10, there are provided developing units 13 each being for each color which represent developing means each containing a developing agent composed of yellow (Y) toner and a carrier, that composed of magenta (M) toner and a carrier, that composed of cyan (C) toner and a carrier, or that composed of black (K) toner and a carrier, and development for the first color (yellow, for example) is conducted by developing sleeve 131.

The developing unit 13 develops an electrostatic latent image formed on the photoreceptor drum 10 through the charging by means of the scorotron charging unit 11 and the imagewise exposure made by exposure unit 121, by the reversal development by means of toner having a polarity identical to that in the charging (toner having minus polarity in this embodiment, due to the negatively charged photoreceptor drum), under the non-contact condition by means of a non-contact developing method in which a developing bias voltage is impressed.

There is conducted reversal development in which the developing unit 13 is kept by unillustrated stopper rolls to be out of contact with photoreceptor drum 10, keeping a predetermined clearance of 100 μm–1000 μm, for example, from the photoreceptor drum 10, and a developing bias of D.C. voltage or of D.C. voltage plus A.C. voltage is impressed on the developing sleeve 131 for developing operation made by developing unit 13, then jumping development by means of single-component or two-component developing agents contained in the developing unit is conducted, and D.C. bias of the same polarity (minus polarity in the present embodiment) as in toner is impressed on the negatively charged photoreceptor drum 10 whose transparent conductive layer is grounded so that toner may be stuck on the exposed portion. In this case, accuracy of the clearance for development is required to be about 20 μm or less for preventing unevenness of images.

After development for the first color has been finished, the sequence enters an imaging process for the second color (for example, magenta) in which the photoreceptor drum 10 is charged uniformly again by the scorotron charging unit 11, and a latent image based on image data of the second color is formed through exposure unit 121. In this case, neutralizing by means of uniform exposure means 121*a* conducted in the image forming process for the first color is not conducted. Development by means of a developing agent of the second color of magenta is conducted by developing sleeve 131. The development is conducted in the type of non-contact reversal development, by impressing superposed A.C. bias and D.C. bias between the developing sleeve 131 and the photoreceptor drum 10.

Even for the third (cyan) and fourth (black) colors, the same image forming process as in the second color is conducted, thus, four toner images each having a different color are developed to be superposed on the photoreceptor drum 10 (toner image forming means).

Through the image forming process mentioned above, a superposed color toner image which is to be an image for the reverse is formed on the photoreceptor drum 10 (first image carrier means) serving as an image carrier. Toner image receptor 14*a* is swiveled in the direction shown with dotted line arrow "b" in FIG. 10, around the center represented by the axis of driving roller 14*d*, to be brought into contact with the photoreceptor drum 10. At the fifth turn of the photoreceptor drum 10, the superposed color toner image which is to be an image for the reverse which is formed on the photoreceptor drum 10 is collectively transferred onto toner image receptor 14*a* (second image carrier means) provided to be in contact with the photoreceptor drum 10, at the transfer area 14*b*, by transfer unit 14*c* on which a voltage having a polarity opposite to that of toner is applied. Image data need to be changed so that an image for the obverse to be formed in this case may be a mirror image for the formation of an image for the reverse, on the image carrier.

After the superposed color toner image for the image for the reverse on the photoreceptor drum 10 has been collectively transferred onto the toner image receptor 14*a*, the toner image receptor 14*a* is swiveled again in the direction shown with dotted line arrow "a" in FIG. 10, around the center represented by the axis of driving roller 14*d*, to be separated from the photoreceptor drum 10.

Toner remaining on the photoreceptor drum 10 after the transfer is subjected to neutralizing conducted by image carrier AC neutralizing unit 16 and arrives at cleaning unit 19 where it is removed by cleaning blade 19*a* which is composed of rubber material and is in contact with the photoreceptor drum 10. Further, for eliminating hysteresis caused on the photoreceptor during a period up to the moment of the previous print, the circumferential surface of the photoreceptor is subjected to neutralizing by means of exposure made by precharging uniform exposure unit 12*c* employing a light emitting diode, for example, so that charging for the previous print is removed and the following color image forming for an image for the obverse is conducted.

In the same method as in the color image forming process mentioned above, an image for the obverse of a superposed color toner image is formed on the photoreceptor drum 10.

Next, toner image receptor 14*a* is swiveled in the direction shown with dotted line arrow "b" in FIG. 10 around the center represented by the axis of driving roller 14*d* to be brought into contact with the photoreceptor drum 10, under the condition that an image for the obverse formed on the photoreceptor drum 10 and an image for the reverse formed on the toner image receptor 14*a* are synchronized with each other at the transfer area 14*b*.

Recording sheet P representing a transfer material is fed out of paper feed cassette 15 which is a transfer material storing means by feed out roller 15*a*, then is conveyed by conveyance roller 15*b* to timing roller 15*c*.

The recording sheet P is conveyed by the timing roller 15*c* to transfer area 14*b*, with a color toner image representing an image for the obverse carried on the photoreceptor drum 10 and a color toner image representing an image for the reverse carried on the toner image receptor 14*a* which are synchronized each other. In this case, the recording sheet P is sheet-charged to the same polarity as of toner by sheet charging unit 14*f*, and is adsorbed to the toner image receptor 14*a* to be conveyed to the transfer area 14*b*. Being sheet-charged to the same polarity as of toner, the recording sheet is prevented from attracting a toner image on the toner image receptor and a toner image on the image carrier, thereby disturbance of a toner image is prevented.

An image for the obverse on the circumferential surface of the photoreceptor drum 10 is collectively transferred onto the upper side of the recording sheet P (first transfer means) by transfer unit 14*c* on which a voltage having an opposite polarity to that of toner (plus polarity in this embodiment) is impressed. In this case, an image for the reverse on the circumferential surface of the toner image receptor 14*a* stays on the toner image receptor 14*a* without being transferred onto the recording sheet P. Next, an image for the reverse on the circumferential surface of the toner image receptor 14*a* is collectively transferred onto the lower side of the recording sheet P (second transfer means) by reverse surface transfer unit 14*g* on which a voltage having an opposite polarity to that of toner (plus polarity in this embodiment) is impressed.

Since toner images each having a different color are superposed on each other, it is preferable, for making the collective transfer possible, that toner in the upper layer and toner in the lower layer both in the same toner layer are charged to be the same as each other in terms of quantity of charging and of polarity. However, in duplex image forming in which a color toner image formed on toner image receptor 14*a* is subjected to the polarity reversing conducted by corona discharge, or a color toner image formed on an image carrier is subjected to the polarity reversing conducted by corona discharge, faulty transfer is caused because toner in the lower layer is not charged sufficiently to the same polarity, which is not preferable.

When a color toner image having the same polarity formed by repeating the reversal development and superposing on an image carrier is collectively transferred onto toner image receptor 14*a* without changing its polarity, and then, it is collectively transferred onto recording sheet P without changing its polarity, this contributes to an improvement of transferability in image forming for an image for the obverse, which is preferable.

In the color image forming, therefore, there is preferably employed a duplex image forming method in which a color toner image is formed on the obverse side of a transfer material by employing the method for forming an image for the obverse and that for the reverse mentioned above and by operating the first transfer means, and then a color toner image is formed on the reverse side of the transfer material by operating the second transfer means.

The toner image receptor 14*a* is an endless rubber belt having a thickness of 0.5–2.0 mm which is of a two-layer structure in which the outer surface of a semi-conductive substrate having a resistance value of $10^8$–$10^{12}$ EE cm made of silicone rubber or urethane rubber and that of a rubber substrate are subjected to fluorine coating in thickness of 5–50 μm as a toner filming preventing layer. This layer also needs preferably to be semi-conductive. It is also possible to use semi-conductive polyester, polystyrene and polyethyleneterephthalate each having a thickness of 0.1–0.5 mm, in place of the rubber belt substrate.

The recording sheet P having on its both sides color images is neutralized by sheet separation AC neutralizing unit 14*h* for separating a transfer material, then is separated from the toner image receptor 14*a*, and is conveyed to fixing unit 17 serving as a fixing means composed of two rollers each having therein a heater. Being applied with heat and pressure in the area between fixing roller 17*a* and pressure roller 17*b*, toner sticking to the obverse side and that sticking to the reverse side both of the recording sheet P are fixed, thus, the recording sheet P on both sides of which images have been recorded is conveyed by exit roller 18 to be ejected to a tray which is positioned outside the apparatus.

The toner image receptor 14*a* is swiveled again in the direction shown with dotted line arrow "a" in FIG. 10 around the center represented by an axis of driving roller 14*d*, and is separated from the photoreceptor drum 10. Toner staying on the circumferential surface of the toner image receptor 14*a* after the transfer is removed by toner image receptor cleaning unit 14*i*. Toner staying on the circumferential surface of the photoreceptor drum 10 after the transfer, on the other hand, is subjected to neutralizing made by image carrier AC neutralizing unit 16, then arrives at cleaning unit 19 where it is scraped down in the cleaning unit 19 by cleaning blade 19*a* which is made of rubber material and is in contact with the photoreceptor drum 10, and is collected into an unillustrated toner container by screw 19*b*. The photoreceptor drum 10 from which the remaining toner has been removed by the cleaning unit 19 is charged uniformly by scorotron charging unit 11 of Y to be ready for the following image forming cycle.

Owing to collective transfer of superposed color toner images in the method mentioned above, color doubling on a color image on the toner image receptor and toner scattering or scratches are hardly caused, and excellent color image forming with less deterioration of image can be carried out.

Even in the sixth example of the image forming apparatus mentioned above, there can be conducted various types of duplex image forming, by using control of a high speed movement of a toner image receptor in the same way as in the aforementioned explanation given by referring to FIGS. 4–9, or by making a toner image receptor small. Thus, there is conducted duplex image forming in which speedup of the rate of printing is achieved by efficiently using a toner image receptor representing the second image carrier means.

Figure 12:
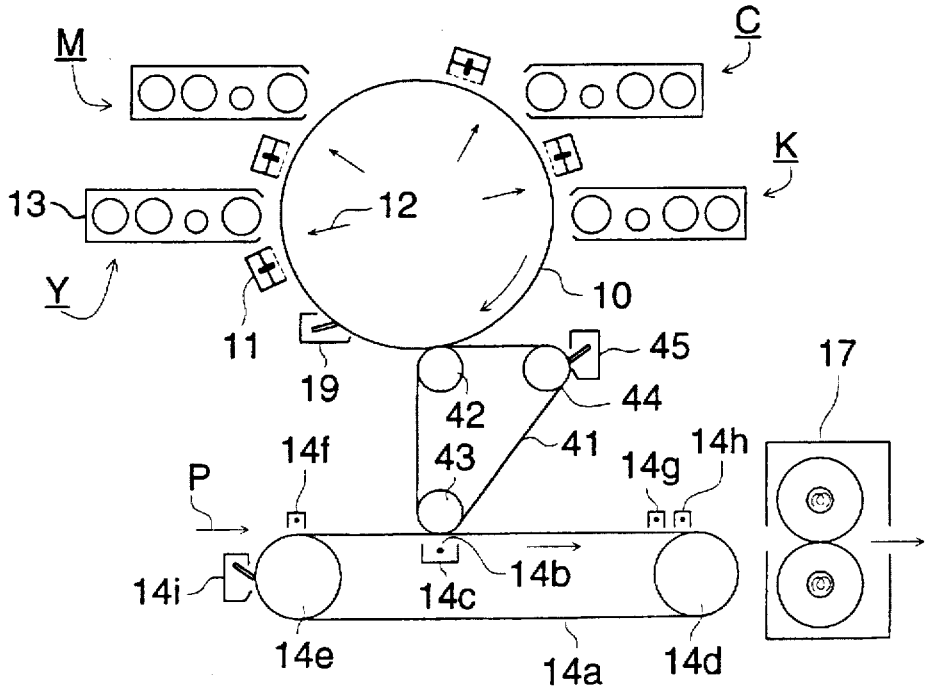
FIG. 12 is a diagram of the sectional structure of the seventh example of an image forming apparatus.

An image forming process and each mechanism of the seventh example of the image forming apparatus in the present embodiment will be explained as follows, referring to FIG. 12. FIG. 12 is a sectional structure diagram of an image forming apparatus. In the present example, a color toner image is formed on an image carrier through the same image forming process as in the image forming method in the first example, and the color toner image on the image carrier is transferred onto a toner image receptor or onto a transfer material through an intermediate transfer body. Accordingly, an arrangement of the toner image receptor and the direction of conveying the transfer material are opposite respectively to those in the image forming apparatus in the first example. Members having the same functions and structures as those in the image forming apparatus in the first example are given the same symbols.

Transfer belt 41 serving as an intermediate transfer body is provided to face photoreceptor drum 10 which serves as an image carrier, and the transfer belt is trained about first roller 42 serving as a transfer roller that presses the intermediate transfer belt 41 against photoreceptor drum 10, second roller 43 that presses the intermediate transfer belt 41 against toner image receptor 14*a* at transfer area 14*b*, and backup roller 44. The numeral 45 represents an intermediate transfer belt cleaning unit.

In the same way as in the explanation of the first example of an image forming apparatus, superposition color toner images are formed on the circumferential surface of photoreceptor drum 10 within a period of time needed for one rotation of the photoreceptor drum 10. (toner image forming means).

A superposition color toner image that is to be an image for the reverse is formed by the toner image forming means on the photoreceptor drum 10 representing an image carrier. The superposition color toner image that is to be an image for the reverse is transferred temporarily onto intermediate transfer belt 41 (first image carrier means) by transfer roller 42, then, in transfer area 14*b*, the superposition color toner image that is to be an image for the reverse is collectively transferred, by transfer unit 14*c* on which a voltage having a polarity opposite to that of toner (plus polarity in this embodiment) is impressed, onto toner image receptor 14*a* (second image carrier means) which is trained about driving roller 14*d* and driven roller 14*e*, and is provided to be close to or to be in contact with the photoreceptor drum 10.

An image for the obverse of a superposition color toner image is formed again on the photoreceptor drum 10 by a toner image forming means, and is transferred onto intermediate transfer belt 41. Image data need to be changed so that the image for the obverse formed in this case may be a mirror image for an image for the reverse, on the image carrier.

Recording sheet P serving as a transfer material is conveyed to transfer area **14*b*, while a color toner image of the image for the obverse which is formed on the photoreceptor drum 10 and then temporarily transferred onto intermediate transfer belt 41 to be carried on it, and a color toner image of an image for the reverse carried on toner image receptor 14*a* are synchronized. In this case, the recording sheet P is subjected, by sheet-charging unit 14*f*, to sheet-charging to be charged to the same polarity as of toner then adsorbed to the toner image receptor 14*a* to be conveyed to the transfer area 14*b***. Being sheet-charged to the same polarity as of toner, the recording sheet is prevented from attracting a toner image on the toner image receptor and a toner image on the image carrier, thereby disturbance of a toner image is prevented.

Transfer unit **14*c* on which a voltage having polarity opposite to that of toner (plus polarity in this embodiment) is impressed collectively transfers an image for the obverse formed on the circumferential surface of intermediate transfer belt 41 onto the upper side of recording sheet P (first transfer means). In this case, an image for the reverse formed on the circumferential surface of the toner image receptor 14*a* stays on the toner. image receptor 14*a* without being transferred onto recording sheet P. Then, reverse side transfer unit 14*g* on which a voltage having polarity opposite to that of toner (plus polarity in this embodiment) is impressed collectively transfers the image for the reverse on the circumferential surface of the toner image receptor 14*a*** onto the lower side of the recording sheet P (second transfer means).

The toner image receptor **14*a*** is an endless rubber belt having a thickness of 0.5–2.0 mm which is of a two-layer structure in which the outer surface of a semi-conductive substrate having a resistance value of $10^8$–$10^{12}$ EE cm made of silicone rubber or urethane rubber and that of a rubber substrate are subjected to fluorine coating in thickness of 5–50 μm as a toner filming preventing layer. This layer also needs preferably to be semi-conductive. It is also possible to use semi-conductive polyester, polystyrene and polyethyleneterephthalate each having a thickness of 0.1–0.5 mm, in place of the rubber belt substrate.

The recording sheet P having on its both sides color images is neutralized by sheet separation AC neutralizing unit **14*h* for separating a transfer material, then is separated from the toner image receptor 14*a*, and is conveyed to fixing unit 17** serving as a fixing means composed of two rollers each having therein a heater. When heat and pressure are applied on the recording sheet P, toner sticking to the obverse side and toner sticking to the reverse side both of the recording sheet P are fixed, thus duplex image recording is conducted on the recording sheet P which is then ejected to a tray that is located outside the apparatus.

Toner remaining on the circumferential surface of the toner image receptor **14*a* after transfer in the present example is removed by a blade of toner image receptor cleaning unit 14*i* which is capable of being brought into contact with or being released from the toner image receptor 14*a***.

Owing to collective transfer of superposed color toner images in the method mentioned above, color doubling on a color image on the toner image receptor and toner scattering or scratches are hardly caused, and excellent color image forming with less deterioration of image can be carried out.

Even in the seventh example of the image forming apparatus mentioned above, there can be conducted various types of duplex image forming, by using control of a high speed movement of a toner image receptor in the same way as in the aforementioned explanation given by referring to FIGS. 4–9, or by making a toner image receptor small. Thus, there is conducted duplex image forming in which speedup of the rate of printing is achieved by efficiently using a toner image receptor representing the second image carrier means.

In the first–seventh examples of an image forming apparatus, it is naturally possible to copy only on a single side by means of the first image carrier means or the second image carrier means.

The invention can further be applied to a monochromatic image forming apparatus undoubtedly, though the explanation has been made so far using a color image forming apparatus. Further, the invention can be applied also to the variation of duplex image forming without being limited to the present system. For example, the system for changing the process conditions and image data processing conditions between the obverse side and the reverse side explained above can be used for the technology shown in Japanese Patent Examined Publication No. 28740/1979 in which toner polarity corresponding to an image for the reverse is reversed and then they are transferred onto both sides of a transfer material simultaneously, and that system can also be used for the tandem system disclosed in Japanese Patent O.P.I. Publication Nos. 180969/1988, 298255/1988 and 44457/1989, thus, duplex image forming for images having satisfactory image density and image tone can be conducted.

The invention makes it possible to improve an efficiency for using the second image carrier means and to achieve speedup of the rate of printing for duplex image forming.

The invention further makes it possible to achieve speedup of the rate of printing for duplex image forming on a single small-sized sheet.

The invention further makes it possible to achieve speedup of the rate of printing for image forming, in particular.

The invention can further make a color image forming apparatus small by making a toner image receptor representing the second image carrier means small, and can achieve speedup of the rate of printing for duplex image forming by making the second image carrier means small.

The invention further makes it possible to prevent unnecessary image forming.

The invention further makes duplex image forming possible even by the small-sized second image carrier means.

The invention further can achieve efficient usage of the second image carrier means.

What is claimed is:

1. An image forming apparatus, comprising:

a first image carrier;

a toner image forming unit for forming a toner image on said first image carrier;

a second image carrier, disposed facing said first image carrier, for holding said toner image, formed on said first image carrier, on a surface of said second image carrier;

a first transfer unit for transferring said toner image, on said first image carrier, to one side surface of a transfer material;

a second transfer unit for transferring said toner image, on said second image carrier, to another side surface of said transfer material;

a fixing unit for fixing said toner image, transferred to both side surfaces of said transfer material by said first transfer unit and said second transfer unit, onto said transfer material;

an image size discriminator which discriminates a size of an image to be formed by said image forming apparatus, and which generates a signal corresponding to the discriminated size of said image; and a controller for controlling said image forming apparatus so that either said toner image corresponding to one page is formed on said second image carrier or said toner image corresponding to a plurality of pages is formed on said second image carrier according to said signal generated by said image size discriminator.

2. An image forming apparatus, comprising:

a first image carrier;

a toner image forming unit for forming a toner image on said first image carrier;

a second image carrier, disposed facing said first image carrier, for holding said toner image, formed on said first image carrier, on a surface of said second image carrier;

a first transfer unit for transferring said toner image, on said first image carrier, to one side surface of a transfer material;

a second transfer unit for transferring said toner image, on said second image carrier, to another side surface of said transfer material;

a fixing unit for fixing said toner image, transferred to both side surfaces of said transfer material by said first transfer unit and said second transfer unit, onto said transfer material;

an image size discriminator which discriminates a size of an image to be formed by said image forming apparatus, and which generates a signal corresponding to the discriminated size of said image; and a controller for controlling a moving speed of said surface of said second image carrier so that said surface moves at a first speed when said surface is moved for forming said toner image on said surface and said surface moves at a second speed, faster than said first speed, when said surface is moved for setting said toner image on said surface to a transfer position of said second transfer unit.

3. The image forming apparatus of claim 2, wherein said first image carrier and said second image carrier move in a same direction when said surface of said second image carrier moves at said second speed.

4. The image forming apparatus of claim 2, wherein said first image carrier moves in an opposite direction to that of said second image carrier when said surface of said second image carrier moves at said second speed.

5. An image forming apparatus, comprising:

a first image carrier;

a toner image forming unit for forming a toner image on said first image carrier;

a second image carrier, disposed facing said first image carrier, for holding said toner image, formed on said first image carrier, on a surface of said second image carrier;

a first transfer unit for transferring said toner image, on said first image carrier, to a first side surface of a transfer material;

a second transfer unit for transferring said toner image, on said second image carrier, to a second side surface of said transfer material;

a fixing units for fixing said toner image, transferred to both side surfaces of said transfer material by said first transfer unit and said second transfer unit, onto said transfer material; and an image size discriminator which discriminates a size of an image to be formed by said image forming apparatus, and which generates a signal corresponding to the discriminated size of said image;

wherein said image size discriminator discriminates whether or not said image to be formed by said image forming apparatus is larger than a maximum size that said second image carrier is able to hold thereon.

6. The image forming apparatus of claim 5, further comprising:

a controller for suspending an image forming operation of said image forming apparatus when said image size discriminator discriminates that a size of an image to be formed on said second side surface of said transfer material is larger than said maximum size that said second image carrier is able to form.

7. The image forming apparatus of claim 5, further comprising:

a controller for generating an alarm signal when said image size discriminator discriminates that a size of an image to be formed on said second side surface of said transfer material is larger than said maximum size that said second image carrier is able to form.

8. The image forming apparatus of claim 5, further comprising:

a controller for controlling said toner image forming unit so that a reduced image of an image, to be formed on said second side surface of said transfer material, is formed on said second image carrier when said image size discriminator discriminates that the size of said image to be formed on said second side surface of said transfer material is larger than said maximum size that said second image carrier is able to form.

9. The image forming apparatus of claim 5, further comprising:

a controller for controlling said toner image forming unit so that a part of an image, to be formed on said second side surface of said transfer material, is formed on said second image carrier when said image size discriminator discriminates that the size of said image to be formed on said second side surface of said transfer material is larger than said maximum size that said second image carrier is able to form.

* * * * *